US012151176B2

(12) United States Patent
Liao

(10) Patent No.: US 12,151,176 B2
(45) Date of Patent: Nov. 26, 2024

(54) CHESSBOARD AND CHESS

(71) Applicant: Junqu Liao, Shenzhen (CN)

(72) Inventor: Junqu Liao, Shenzhen (CN)

( * ) Notice: Subject to any disclaimer, the term of this patent is extended or adjusted under 35 U.S.C. 154(b) by 0 days.

(21) Appl. No.: 18/536,746

(22) Filed: Dec. 12, 2023

(65) Prior Publication Data

US 2024/0108970 A1 Apr. 4, 2024

(51) Int. Cl.
*A63F 3/00* (2006.01)
*A63F 3/02* (2006.01)

(52) U.S. Cl.
CPC ..... *A63F 3/00643* (2013.01); *A63F 3/00895* (2013.01); *A63F 3/022* (2013.01); *A63F 2003/00652* (2013.01); *A63F 2003/00668* (2013.01); *A63F 2003/00952* (2013.01)

(58) Field of Classification Search
CPC .. A63F 3/00643; A63F 3/00895; A63F 3/022; A63F 2003/00652; A63F 2003/00668; A63F 2003/00952
See application file for complete search history.

(56) References Cited

U.S. PATENT DOCUMENTS 3,654,392 A * 4/1972 Beinhocker ..... A63F 3/022 273/237
2003/0079387 A1* 5/2003 Derose ..... G02B 6/0083 362/812
2012/0190420 A1* 7/2012 Wu ..... A63F 3/02 463/14
2015/0014930 A1 1/2015 Summerville et al.
2019/0022517 A1 1/2019 Socorregut
2020/0206601 A1* 7/2020 Martin, III ..... A63F 3/02
2021/0170264 A1* 6/2021 King ..... A63F 3/02
2022/0323852 A1 10/2022 Farmer

FOREIGN PATENT DOCUMENTS

CN 218187825 U 1/2023

OTHER PUBLICATIONS

Theron Wierenga, An Electronic Chessboard Using RGB Ledstrips and Hall Effect Sensors, Jan. 2017, nutsvolts.com, available at «https://www.nutsvolts.com/magazine/article/January2017_Electronic-Chessboard-LEDs-Hall-Effect-Sensors». (Year: 2017).*

(Continued)

*Primary Examiner* — Werner G Garner
(74) *Attorney, Agent, or Firm* — Jeenam Park

(57) ABSTRACT

A chessboard includes a housing having a chessboard area, wherein the chessboard area includes a plurality of chess squares; at least one first magnetic absorbing element arranged in the housing and corresponding to the chessboard area, configured to absorb, at least one chess piece having a second magnetic absorbing element by using a magnetic force; and a plurality of Hall elements arranged in the housing and corresponding to the plurality of chess squares, wherein each Hall element is configured to detect the second magnetic absorbing element of the at least one chess piece in the chess squares, and output a detected signal; and a control module, electrically connected to the plurality of Hall elements and configured to receive the detected signal to get information on the at least one chess piece in the chess squares.

19 Claims, 9 Drawing Sheets

(56) References Cited

OTHER PUBLICATIONS

Theron Wierenga, An Electronic Chessboard Using RGB Ledstrips and Hall Effect Sensors—Part 2, Feb. 2017, nutsvolts.com, available at «https://www.nutsvolts.com/magazine/article/February2017_Electronic-Chessboard-LEDs-Hall-Effect-Sensors-Part-2». (Year: 2017).*
Champion Sensory Chess Challenger, 1981, Fidelity Electronics, Ltd. (Year: 1981).*
Johnnyrooker, I've had the Square Off Pro chessboard for aweek. This is my review., Aug. 8, 2022, chess.com, available at «https://www.chess.com/blog/JohnnyRooker/ive-had-the-square-off-pro-chessboard-for-a-week-this-is-my-review». (Year: 2022).*
chessroboto, Just Announced—Millennium Exclusive Luxe Edition, Jan. 14, 2021, chess.com, available at «https://www.chess.com/forum/view/chess-equipment/just-announced-millennium-exclusive-luxe-edition». (Year: 2021).*
Karpov Chess School M806, 2018, Millenium 2000 GmbH. (Year: 2018).*
Saitek Cosmic Chess, 2002, Saitek Ltd. (Year: 2002).*

* cited by examiner

CHESSBOARD AND CHESS

TECHNICAL FIELD

The present disclosure relates to the technical field of toys, in particular, to an intelligent chessboard and an intelligent chess.

BACKGROUND

Chess is one of many chess games. It is also called checkers. It is a chess game played by two people against each other. Generally, the chessboard is in a shape of a square consisting of 64 black and white cells. There are 32 pieces of chess in black and white, and 16 pieces for each player. Although it is called an international chess or checkers, it originated in Asia and was introduced into Europe by Arabs. It is also an intellectual sport and has been listed as a formal competition event of the Olympic Games, and has been favored by consumers.

The industry proposes an intelligent chess toy, which can be used or practiced by a user. However, how to intelligently detect chess information on a chessboard and improve user experience is an important task.

SUMMARY

The present disclosure provides a chessboard and a chess.

An embodiment of the present disclosure provides a chessboard. The chessboard includes a housing having a chessboard area, wherein the chessboard area includes a plurality of chess squares; at least one first magnetic absorbing element arranged in the housing and corresponding to the chessboard area, configured to absorb, at least one chess piece having a second magnetic absorbing element by using a magnetic force; and a plurality of Hall elements arranged in the housing and corresponding to the plurality of chess squares, wherein each Hall element is configured to detect the second magnetic absorbing element of the at least one chess piece in the chess squares, and output a detected signal; and a control module, electrically connected to the plurality of Hall elements and configured to receive the detected signal to get information on the at least one chess piece in the chess squares.

In at least one embodiment, the housing includes a bottom case, a front case, and a cover plate, wherein the front case is connected to the bottom case to enclose an accommodating space, the Hall elements are arranged in the accommodating space, the chessboard area is arranged on the cover plate, the front case has a main area, and the cover plate is arranged on a side of the front case away from the bottom case and covers the main area; and the first magnetic absorbing element is arranged on the front case and is configured to absorb the at least chess piece by the magnetic force via the cover plate.

In at least one embodiment, the chessboard further includes a chess accommodating drawer, one side of the bottom case defines a drawer opening, and the chess accommodating drawer is mounted in the drawer opening and slidably connected to the bottom case, so that the chess accommodating drawer may be switched between an accommodating state where the accommodating drawer is accommodated inside the bottom case and an extended state where at least a part of the accommodating drawer extending out of the bottom case through the drawer opening; and the Hall elements are arranged between the chess accommodating drawer and the front case.

In at least one embodiment, the first magnetic absorbing element is arranged between the main area of the front case and the cover plate or between the main area of the front case and the Hall elements; and the first magnetic absorbing element is of metal material and includes a plurality of magnetic absorbing regions corresponding to the chess squares, and each magnetic absorbing region has a hollowed-out region; the chessboard further includes a plurality of light emitting elements arranged in the accommodating space and corresponding to the plurality of chess squares respectively, wherein the cover plate is a light transmitting element, the main area is light-transmitting, and light emitted by the light emitting elements is emitted out of the chessboard through the main area, the hollowed-out areas, and the cover plate; and the control module is arranged in the housing and is electrically connected to the light emitting elements and the Hall elements, and the control module is further configured to control on and off of the light emitting elements according to the detected signal.

In at least one embodiment, the chessboard further includes a light guiding plate, the light guiding plate is arranged on a side of the light emitting elements adjacent to the main area, and light emitted by the light emitting elements enters the main area through the light guiding plate.

In at least one embodiment, the chessboard further includes a bracket, and the bracket is arranged between the light guiding plate and the Hall elements and is configured to support the light guiding plate.

In at least one embodiment, the chessboard further includes a circuit board, the light emitting elements and the Hall elements are arranged on the circuit board and are electrically connected to the circuit board, the circuit board is further electrically connected to the control module, and the light emitting elements and the Hall elements that corresponding to each of the chess squares are arranged adjacent to each other.

In at least one embodiment, each hollowed-out area includes a first hollowed-out area and multiple second hollowed-out areas surrounding the first hollowed-out area; and the main area includes multiple third hollowed-out areas corresponding to the second hollowed-out areas and multiple supporting members each surrounded by several third hollowed-out areas, and the support portions are corresponding to the first hollowed-out area one by one and each has a same shape with a corresponding one of the first hollowed-out areas.

In at least one embodiment, the plurality of chess squares includes a plurality of first chess squares having a first printed pattern and/or material and a plurality of second chess squares having a second printed pattern and/or material different from the first printed pattern and/or material.

In at least one embodiment, the information on the chess pieces includes information about whether a chess piece is placed in one of the chess squares, the control module determines, according to the detected signal, whether a chess piece is placed in a current chess square and whether a chess piece in the current chess square is leaving the current chess square, and the control module is further configured to: record identity information of the chess piece in each of the chess square, and control, when a chess piece in the current chess square is detected to be leaving the current chess square, the light emitting element corresponding to one or more of the chess squares surrounding the current chess square to emit light, so as to indicate the one or more chess squares that the chess piece in the current chess square can move in.

In at least one embodiment, the control module is further configured to: control a light emitting element corresponding to the current chess square to emit light to display identity information of the chess piece in the current chess square when it is detected that the chess piece in the current chess square is leaving the current chess square.

In at least one embodiment, the control module is further configured to control the Hall element to re-detect chess information or to output information that reminds a user to move the current chess piece to a previous position, when information on the current chess piece cannot be got according to the detected signal.

In at least one embodiment, if there are multiple candidate chess squares that the current chess piece can be moved in, the control module further controls the light emitting element corresponding to the multiple candidate chess squares to emit light in different colors and/or brightness, and the different colors and/or brightness are configured to indicate different recommended levels of moving chess pieces.

In at least one embodiment, the chessboard is configured with a companion mode, a competition mode, and a double-person mode, in the companion mode, the chessboard is configured with multiple optional difficulty levels, in the competition mode, the chessboard disables sound and/or light, and in the double-person mode, the chessboard records game information and supports replaying a chess game.

In at least one embodiment, the chessboard further includes a voice module, the voice module is electrically connected to the control module, and the control module is further configured to control the voice module to play voice to report a current game situation, reminder information, chess abnormal information, and/or urging opponent to play chess.

In at least one embodiment, the housing further includes a display opening, the chessboard further includes a display screen, the display screen is arranged in the housing and exposed through the display opening, and the display screen is configured to display current game information and a game result simultaneously; and the display screen is an electronic ink screen, and the display screen is arranged on a side of the chessboard area.

In at least one embodiment, the control module is further configured to: detect whether no chess is moved in a predetermined time period or whether a power key is triggered, and if no chess is moved in a predetermined time period or the power key is triggered, and the current game is recorded, and when the chessboard is powered on again or used again, the control module controls the current display screen to continue displaying the current game.

In at least one embodiment, the chessboard further includes a key module, the key module is used for operation by a user, the key module is electrically connected to the control module, and the control module is further configured to receive a control signal generated when the key is triggered to control the chessboard; and the key module includes a start/pause key, the control module controls the chessboard to enable a new game or to or pause/continue a current game according to a control signal generated when the start/pause key is triggered, and the key is arranged on at least one side of the chessboard area.

In at least one embodiment, the key module further includes at least one pawn promotion key, wherein the at least one pawn promotion key is a control key that is used to generate a pawn promotion control signal when being triggered to control a chess piece representing a Pawn that currently reaches a pawn promotion area to become a chess piece representing a Queen, a Knight, a Rook, or a Bishop.

In at least one embodiment, the chessboard has a chessboard time setting function, an endgame exercise function, at least one of playing chess according to a voice, a light, or a display screen prompt, a scoring function, and initiating draw, and if the endgame exercise function is enabled, the intelligent chessboard outputs a voice, light, and/or a display prompt to prompt a user how to position chess pieces.

Another embodiment of the present disclosure provides a chess. The chess includes a chessboard and a plurality of chess pieces. The chessboard includes a housing having a chessboard area, wherein the chessboard area includes a plurality of chess squares; at least one first magnetic absorbing element arranged in the housing and corresponding to the chessboard area, configured to absorb, at least one chess piece having a second magnetic absorbing element by using a magnetic force; and a plurality of Hall elements arranged in the housing and corresponding to the plurality of chess squares, wherein each Hall element is configured to detect the second magnetic absorbing element of the at least one chess piece in the chess squares, and output a detected signal; and a control module, electrically connected to the plurality of Hall elements and configured to receive the detected signal to get information on the at least one chess piece in the chess squares.

In at least one embodiment, each chess piece includes a cavity and a mounting slot communicated with the cavity, the mounting slot is arranged at a bottom of the chessboard, and the second magnetic absorbing element is fastened in the mounting slot.

In the intelligent chess provided by the present disclosure, at least one of the first magnetic elements can not only magnetically adsorb the chess pieces to prevent the chess pieces from leaving the chessboard, but also allow the Hall elements to detect the second magnetic elements of the chess pieces placed in the chessboard area, so that the control module can get the information on the chess pieces in the chessboard area, so as to realize intelligent control. Through the Hall elements, the chess piece can be fixed and detected by setting only the second magnetic elements, which is not only simple and reliable in structure, but also low in cost and better in user experience.

BRIEF DESCRIPTION OF THE DRAWINGS

Implementations of the present disclosure will now be described, by way of embodiment, with reference to the attached figures. It should be understood, the drawings are shown for illustrative purpose only, for ordinary person skilled in the art, other drawings obtained from these drawings without paying creative labor by an ordinary person skilled in the art should be within scope of the present disclosure.

DETAILED DESCRIPTION OF THE EMBODIMENTS

Figure 1:
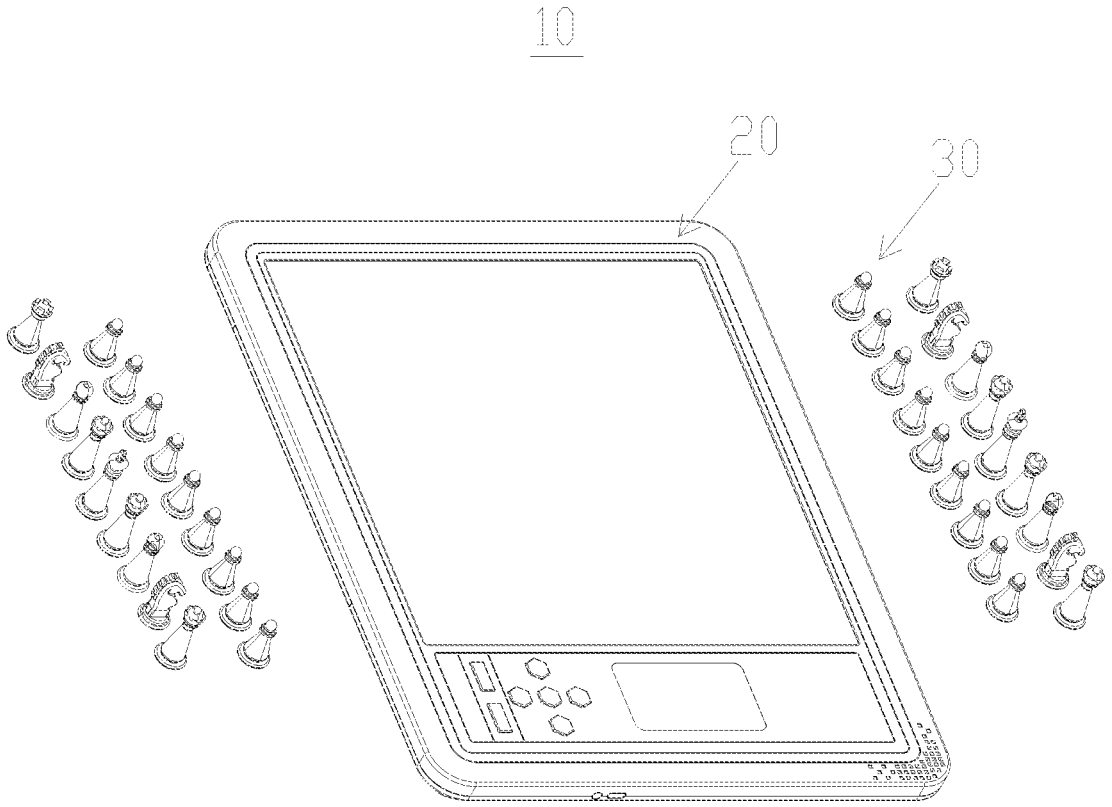
FIG. 1 is a schematic structural diagram of a chess according to a first embodiment of the present disclosure, the chess including a chessboard and chess pieces.
Figure 2:
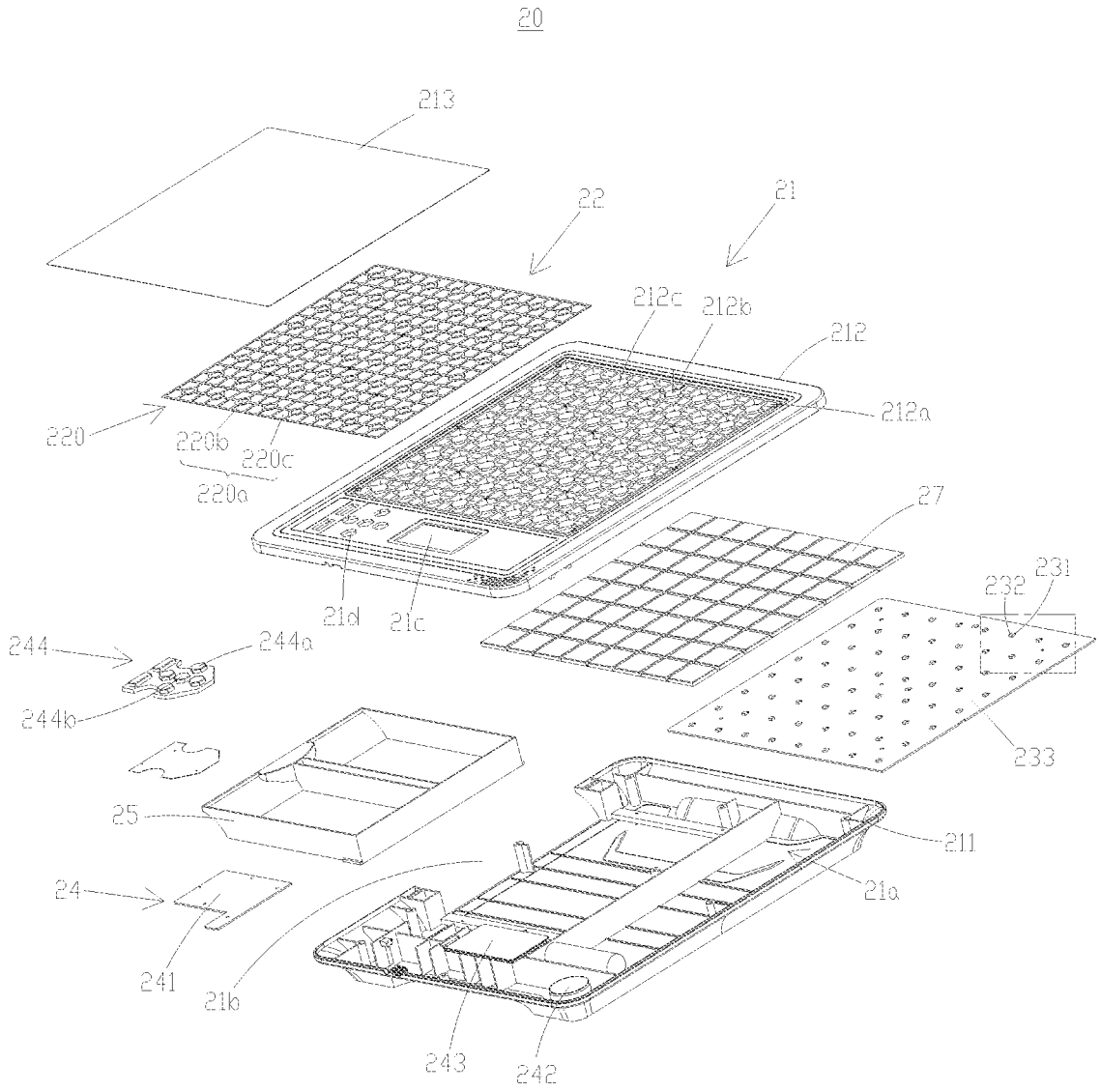
FIG. 2 is an exploded view of the chessboard according to the first embodiment of the present disclosure.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein may be practiced without these specific details. In other instances, methods, procedures, and components have not been described in detail so as not to obscure the related relevant feature being described. Also, the description is not to be considered as limiting the scope of the exemplary embodiments described herein. The drawings are not necessarily to scale and the proportions of certain parts may be exaggerated to better illustrate details and features of the present disclosure.

The term "comprising" when utilized, means "including, but not necessarily limited to"; it specifically indicates open-ended inclusion or membership in the so-described combination, group, series, and the like. The disclosure is illustrated by way of example and not by way of limitation in the figures of the accompanying drawings in which like references indicate similar elements. It should be noted that references to "an" or "one" embodiment in this disclosure are not necessarily to the same embodiment, and such references can mean "at least one". In addition, the terms "first" and "second" are used for descriptive purposes only and cannot be understood as indicating or implying relative importance or implying the number of indicated technical features. Thus, the features defined as "first" and "second" may explicitly or implicitly include one or more of the said features. In the description of embodiments of the application, "a plurality of" means two or more, unless otherwise specifically defined.

It should be noted that when a component is described as to be "fixed" on another component, it may be directly on said another component or may be fixed to said another component through an intermediate component. When one component is considered to be "connected" to another component, it may be connected directly to another component or may be connected to another component via an intermediate component. The terms "inside", "outside", "left", "right" and the like used herein are for purposes of illustration only and are not intended to represent the only embodiment.

Unless otherwise defined, all technical and scientific terms used in the present disclosure have the same meaning as those commonly understood by those skilled in the art. The terms used in the present disclosure are merely intended to describe specific embodiments, and are not intended to limit this application. The term "and/or" as used herein includes any and all combinations of one or more associated listed items.

Referring to FIGS. 1-4, a first embodiment of the present disclosure provides an intelligent chess set 10, which includes an intelligent chessboard 20 and chess pieces 30. The intelligent chessboard 20 includes a housing 21, at least one first magnetic absorbing element 22, a plurality of Hall elements 231, and a control module 24. The housing 21 includes a chessboard area 210 having a plurality of chess squares 210*c*. The at least one first magnetic absorbing element 22 is arranged in the housing 21 corresponding to the chess area 210 and is configured to absorb at least one check piece 30 with a second magnetic absorbing element 33. The plurality of Hall elements 231 is arranged in the housing 21 corresponding to the chess squares 210*c*. Each Hall element 231 is configured to detect corresponding one of the second magnetic absorbing elements 33 of the chess pieces 30 in the chess squares 210*c* and to output detected signals. The control module 24 is electrically connected to the Hall elements 231 and is configured to receive the detected signals to get information on the chess pieces on the chess squares 210*c*.

In the intelligent chess 10 provided in the embodiment of the present disclosure, it not only allow the at least one first magnetic absorbing element 22 to absorb the chess pieces by using a magnetic force, so as to avoid that the chess piece 30 is separated from the intelligent chessboard 20, but also allow the Hall elements 231 to detect the second magnetic absorbing elements 33 of the chess pieces 30 placed in the chess squares 210*c*, so that the control module 24 can learn information on chess pieces on the chess area 210, thereby achieving intelligent control of the chess pieces. Through the Hall elements 231, the fixing and detection of the chess pieces 30 can be realized by arranging only the second magnetic elements 33, which is not only simple and reliable in structure, but also low in cost and better in user experience.

Figure 3:
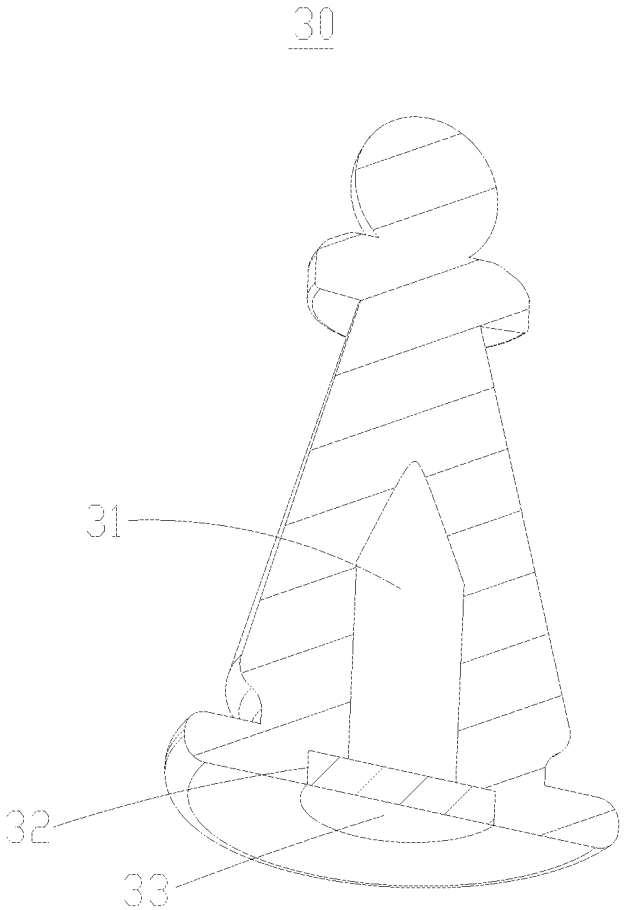
FIG. 3 is a sectional view of the chess piece according to the first embodiment of the present disclosure.
Figure 4:
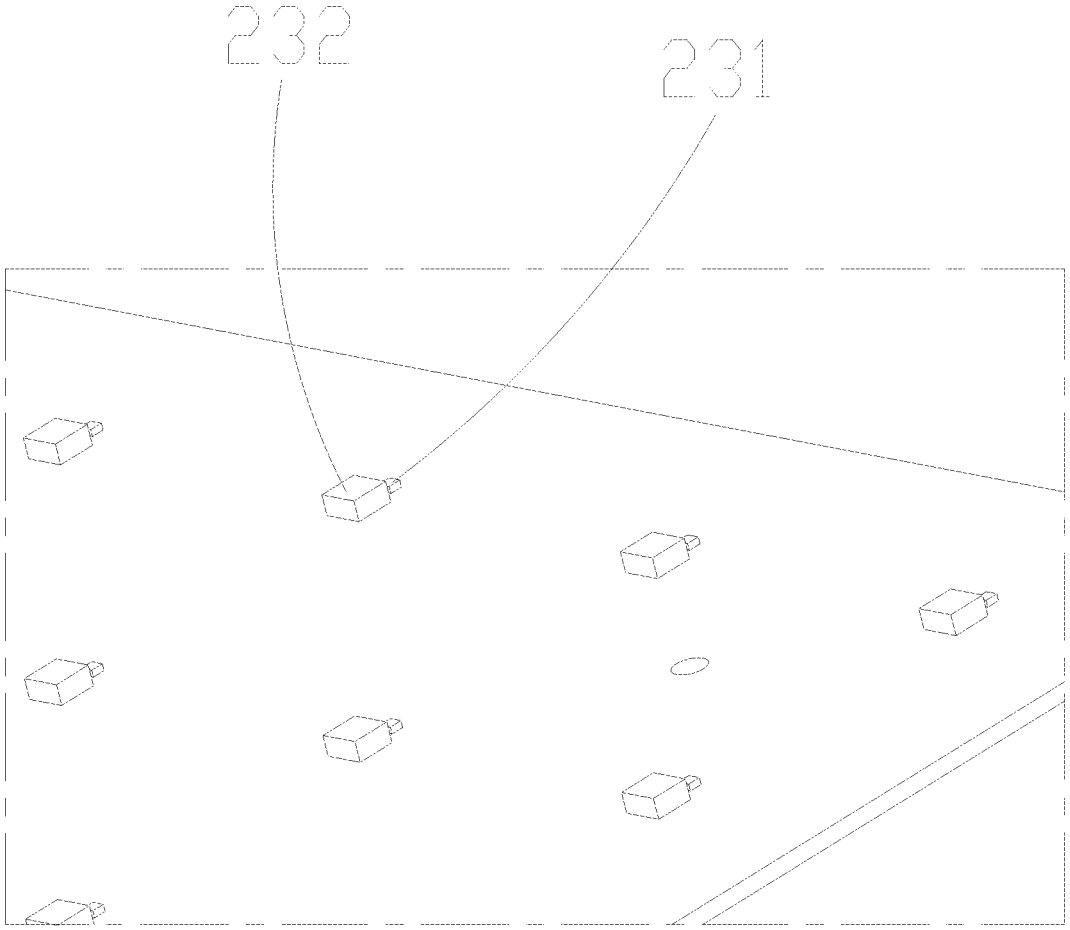
FIG. 4 is a partial enlarged view of the chessboard in FIG. 2.

Specifically, as shown in FIG. 3, each chess piece 30 has a cavity 31 and a mounting slot 32 communicated with the cavity 31, the mounting slot 32 is arranged at a bottom of the chess piece 30, and the second magnetic absorbing element 33 is fastened in the mounting slot 32. The second magnetic absorbing element 33 may be a magnet, such as a permanent magnet.

In this embodiment, the housing 21 includes a bottom case 211, a front case 212, and a cover plate 213. The front case 212 is connected to the bottom case 211 to enclose an accommodating space 21*a*. The Hall elements 231 are located in the accommodating space 21*a*. The chess squares 210*c* is arranged on the cover plate 213. The front case 212 has a main area 212*a*. The cover plate 213 is located on a side of the front case 212 away from the bottom case 211 and covers the main area 212*a*. The first magnetic absorbing element 22 is arranged on the front case 212, and is configured to absorb the chess pieces 30 by using a magnetic force via the cover plate 213. The bottom case 211 and the front case 212 may be fastened to each other through a snap-fit to form the accommodating space to accommodate the Hall elements 231, so as to achieve a convenient assembly and reliable structure.

Further, the intelligent chessboard 20 further includes an accommodating drawer 25, one side of the bottom case 211 defines a drawer opening 21*b*, and the accommodating drawer 25 is mounted in the drawer opening 21*b* and slidably connected to the bottom case 211, so that the accommodating drawer 25 may switched between an accommodating state where the accommodating drawer 25 is accommodated inside the bottom case 211 and an extended state where at least a part of the accommodating drawer 25 extending out of the bottom case 211 through the drawer opening 21*b*. The Hall elements 231 are located between the accommodating drawer 25 and the front case 212. The chess pieces 30 may be accommodated in the accommodating drawer 25, which can further improve user experience. The Hall elements 231 are arranged between the accommodating drawer 25 and the front case 212, so that the intelligent chessboard 20 has a compact structure, a reasonable layout, and a relatively small occupied space.

Further, in this embodiment, the first magnetic absorbing element 22 is arranged between the main area 212*a* of the front case 212 and the cover plate 213. The first magnetic absorbing element 22 is of metal material and has a plurality of magnetic absorbing regions 220 corresponding to the chess squares 210*c*, and each magnetic absorbing region 220 includes a hollowed-out region 220*a*. The intelligent chessboard 20 further includes a plurality of light emitting elements 232 arranged in the accommodating space 21*a* and corresponding to the plurality of chess squares 210*c* respectively. The cover plate 213 is a light transmitting element, the main area 212*a* is light-transmitting, and light emitted by the light emitting element 232 is emitted out via the main area 212*a*, the hollowed-out regions 220*a*, and the cover plate 213. The control module 24 is arranged in the housing 21, and is electrically connected to the light emitting elements 232 and the Hall elements 231. The control module 24 is further configured to control on and off of the light emitting elements 232 according to the detected signal. Specifically, the first magnetic absorbing element 22 is a steel material. It may be understood that, by arranging the hollowed-out area 220*a*, not only light may be transmitted, but also the magnetic force between the first magnetic absorbing element 22 and the second magnetic absorbing element 33 may be enhanced, so as to avoid that the chess pieces 30 is easily separated from the intelligent chessboard 20, thereby improving reliability.

Further, the intelligent chessboard 20 further includes a light guiding plate 27, where the light guiding plate 27 is arranged on a side of the light emitting elements 232 adjacent to the main area 212*a*, and light emitted by the light emitting element 232 enters the main area 212*a* via the light guiding plate 27. It may be understood that the light guiding plate 27 not only provides support to the front case 212, but also achieves a relatively good lighting effect.

Further, the intelligent chessboard 20 further includes a circuit board 233. Both the light emitting elements 232 and the Hall elements 231 are arranged on the circuit board 233 and electrically connected to the circuit board 233. The circuit board 233 is further electrically connected to the control module 24. The light emitting elements 232 and the Hall elements 231 that corresponding to each of the chess squares 210*c* may be arranged adjacent to each other. It may be understood that the plurality of the light emitting elements 232 and the plurality of the Hall elements 231 are arranged on the circuit board 233, which is reasonable in layout and compact in structure, thus helping improve product reliability, and achieving lightweight and miniaturization of the chess.

In this embodiment, each hollowed-out region 220*a* includes a first hollowed-out area 220*b* and multiple second hollowed-out areas 220*c* surrounding the first hollowed-out area. The main area 212*a* includes multiple third hollowed-out areas 212*b* corresponding to the second hollowed-out area, and multiple supporting members 212*c* each surrounded by several third hollowed-out areas 212*b*. The supporting members 212*c* are corresponding to the first hollowed-out areas 220*b* one by one and each has a same shape with corresponding first hollowed-out areas 220*b*. By using such arrangement, magnetic absorption and light effect can be further improved, thus further improving user experience.

Figure 5:
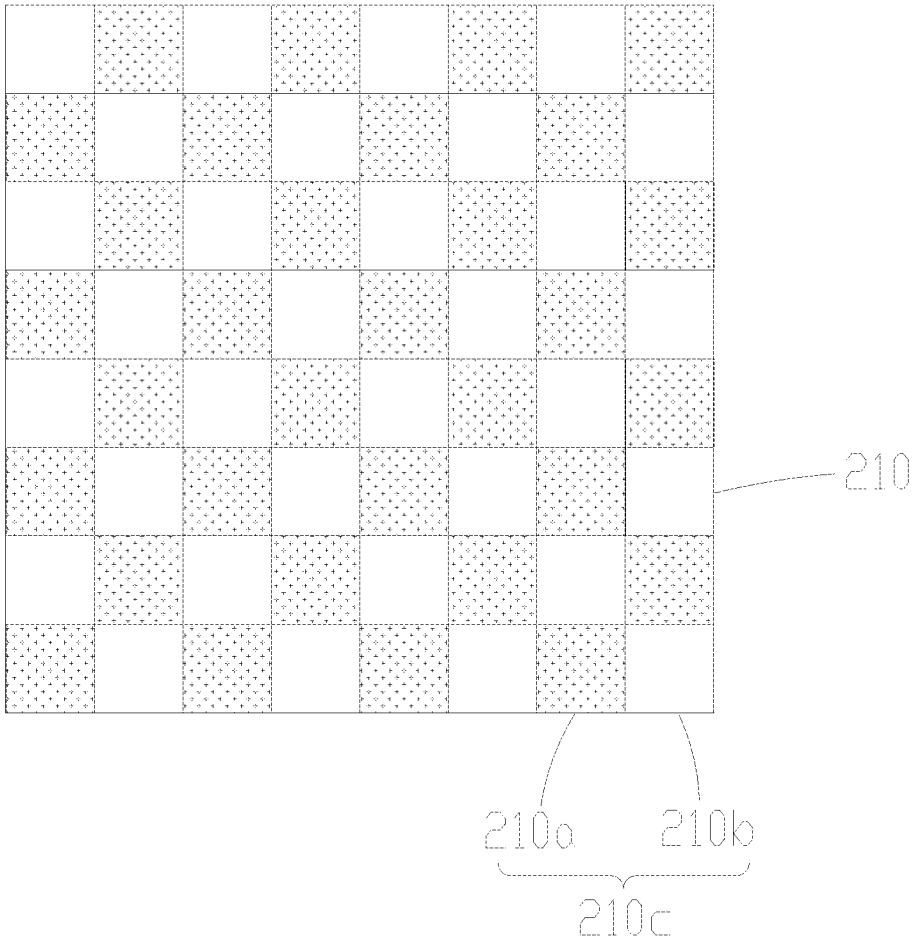
FIG. 5 is a plan view of a chessboard area of the chessboard according to the first embodiment of the present disclosure.

Referring to FIG. 5, the plurality of chess squares 210*c* include a plurality of first chess squares 210*a* and a plurality of second chess squares 210*b*, the plurality of first chess squares 210*a* have a first printed pattern and/or a material, and the plurality of second chess squares 210*b* have a second printed pattern and/or a material different from the first printed pattern and/or the material.

Further, the control module 24 may include a main circuit board 241. The information on the chess detected by the control module 24 may include information about whether the chess squares 210*c* is placed with a chess piece 30. The control module 24 determines, according to the detected signal, whether the chess squares 210*c* is placed with the chess piece 30 and whether the chess piece 30 is leaving the chess squares 210*c*. The control module 24 is further configured to record identity information of the chess pieces 30 on the chess squares 210*c*, and to control the light emitting elements corresponding to one or more chess squares 210*c* around a current chess square 210*c* to emit light when detecting that a current chess piece 30 is leaving the current chess square 210*c*, so as to indicate one or more chess squares 210*c* which allows the current chess piece 30 to enter. The identification information of the chess 30 may include a type of the chess, which specifically such as a king, a queen, and a soldier. In addition, the control module 24 is further configured to control the light emitting elements 232 corresponding to the current chess square 210*c* to emit light to display identity information of the current chess piece 30 in the current chess square 210*c* when detecting that the current chess piece 30 in the current chess square 210*c* is leaving the current chess square 210*c*. The light emitting elements 232 can emit light in different colors to represent different identities of the chess pieces 30. For example, rusty red may represent a king, bronze may represent a queen, and ivory white may represent a soldier, which may be specifically set according to an actual requirement.

Figure 6:
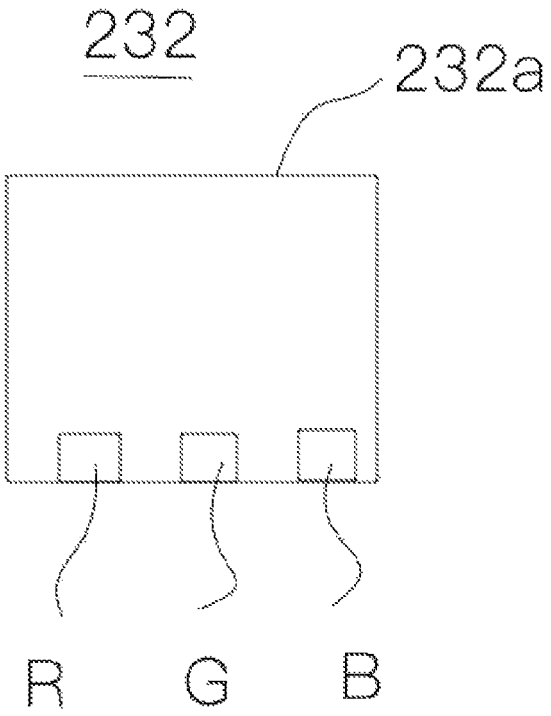
FIG. 6 is a schematic structural diagram of a light emitting element of the chessboard according to the first embodiment of the present disclosure.

As shown in FIG. 6, each light emitting element 232 may include a light housing 232*a* and three light emitting diodes R, G, and B arranged in the light housing 232*a*. The three light emitting diodes R, G, and B are respectively configured to emit red, green, and blue light. The control module 24 may control a size of a driving signal provided to the three light emitting diodes R, G, and B to control a luminous intensity of the three light emitting diodes R, G, and B, so that light emitted by the three light emitting diodes R, G, and B of the light emitting element 232 can be mixed to a specific color, such as rusty red and bronze.

It may be understood that the control module 24 may record the chessboard information by receiving the detected signals of the plurality of Hall elements 231, that is, record the location information of each chess piece 30 on the intelligent chessboard 20, and record the location change and kill information of each chess piece 30 in each game process. In this embodiment, the control module 24 is further configured to control the Hall elements 231 to re-detect or send information that reminds the user to put the chessboard 30 back to a previous location when the chess piece information cannot be learned according to the detected signal. By such arrangement, an error recorded in a game process can be avoided, and accuracy of recorded game process and user experience can be improved.

In this embodiment, if there are multiple candidate chess squares 210*c* that can be walked by a current chess piece 30 in a current chess squares 210*c*, the control module 24 further controls the light emitting elements 232 corresponding to the multiple candidate chess squares 210*c* to emit light in different colors and/or brightness, where the different colors and/or brightness are used to indicate different chess squares recommendation levels. For example, when one of the chess pieces 30 is picked up, the control module determines, according to the identity information of the chess piece 30 and the chess rule information corresponding to the identity information, the chess squares 210*c* where the chess piece 30 can walk in, and controls the light emitting elements 232 corresponding to the chess squares 210*c* that can be walked in by the chess piece 30 to emit light. Specifically, light emitted by the light emitting elements 232 corresponding to the chess squares 210*c* that can be walked in by the chess piece in the current chess square 210*c* may be in different colors. For example, red color represents a danger area, the chess piece 30 may be killed if walking in the danger area, thus being less recommended; and a green color represents a security area, thus being strongly recommended.

In this embodiment, the intelligent chessboard 20 is configured with a companion mode, a competition mode, and a double-person mode. In the companion mode, the intelligent chessboard 20 has multiple optional difficulty levels. In the competition mode, the intelligent chessboard 20 disables sound and/or light, and in the double-person mode, the intelligent chessboard 20 records game information and supports replaying a chess game. It may be understood that due to the different modes, the intelligent chessboard 20 may be applicable to different groups of people and requirements, and user experience is relatively high.

In the embodiment, the intelligent chessboard 20 further includes a voice module 242. The voice module 242 is electrically connected to the control module 24, and the control module 24 is further configured to control the voice module 242 to play voice to report a current chessboard situation, reminder information, chess abnormal information, and/or urging opponent to play chess. It may be understood that because there is the voice module 242, user experience of the intelligent chessboard 20 is relatively high.

In the embodiment, the housing further defines a display opening 21*c*, the intelligent chessboard 20 further includes a display screen 243, the display screen 243 is located in the housing 21 and is exposed through the display opening 21*c*. The display screen 243 is configured to display current chessboard information and a game result simultaneously. The display screen 243 is an electronic ink screen. It may be understood that, by using the display screen 243, current game information and a result of winning or losing of the current game may be displayed synchronously, thereby improving user experience. The display screen 243 uses an electronic ink screen, which has a low energy consumption and a technical effect of protecting a vision.

In the embodiment, the housing further includes a key opening 21*d*, the intelligent chessboard 20 further includes a key module 244, and the key module 244 is exposed through the key opening 21*d* for user operation. The key module 244 is electrically connected to the control module 24, and the control module 24 is further configured to receive a control signal generated when the key module 244 is triggered to control the intelligent chessboard 20. The key module 244 includes a start/pause key 244*a*, and the control module 24 controls, according to a control signal generated when the start/pause key 244*a* is triggered, the intelligent chessboard 20 to enable a new game or pause/continue a current game. The key module 244 is arranged on at least one side of the chessboard area 210. The key module 244 includes a power key 244*b*, and the control module 24 is further configured to: detect whether no chess is moved in a predetermined time period or whether the power key 244*b* is triggered, if no chess is moved in a predetermined time period or the power key 244*b* is triggered, the current chess game is recorded; when the intelligent chessboard 20 is powered on again or used again, the control module 24 controls the display screen 243 to display the current chess game so that the current chess game can be continued. The intelligent chessboard 20 further has at least one of a chessboard time setting function, an endgame exercise function, playing chess according to a voice, a light, or a display screen prompt, a scoring function, and initiating draw. After the endgame exercise function is enabled, the intelligent chessboard 20 can output a voice, a light, and/or a display prompt, so as to prompt a user how to position chess pieces. The scoring function can score each move and give encouragement, guidance or affirmation in a timely manner.

It may be understood that user experience of the intelligent chessboard 20 is relatively high by setting the key module 244 and above-mentioned functions.

Figure 7:
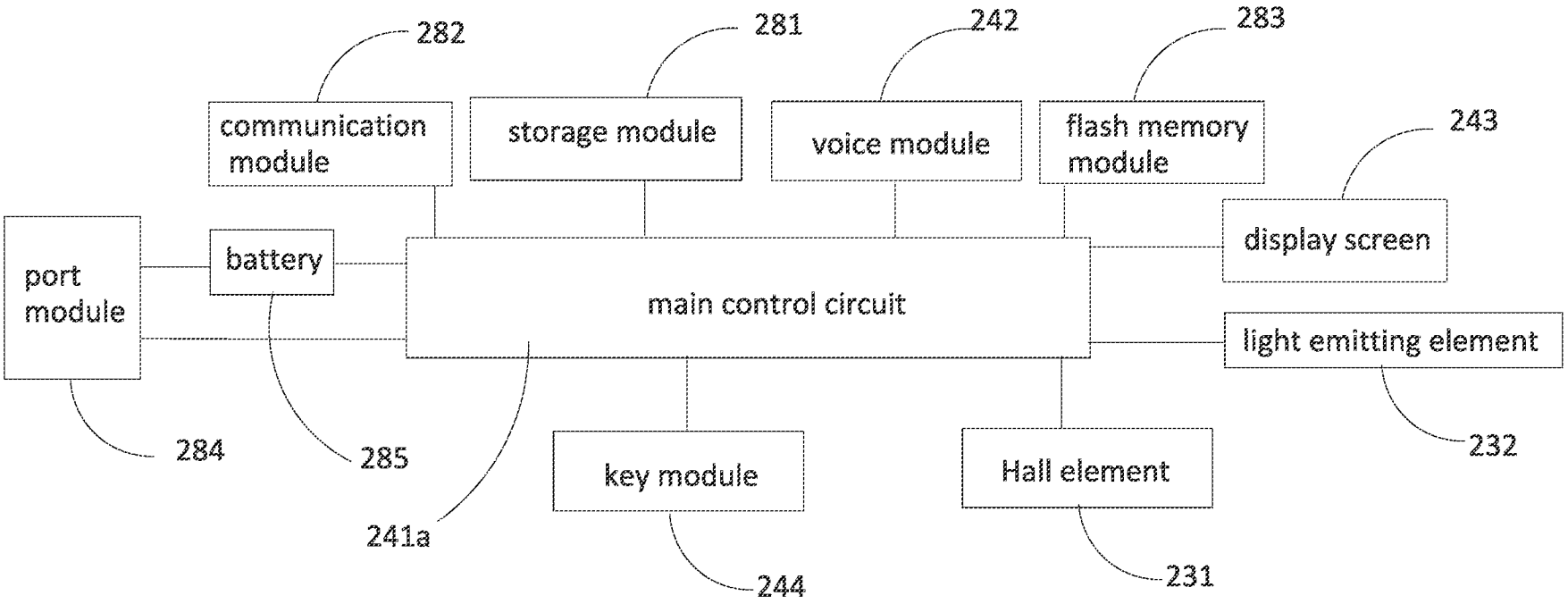
FIG. 7 is a circuit block diagram of the intelligent chessboard according to the first embodiment of the present disclosure.

Referring to FIG. 7, the intelligent chessboard 20 may include a storage module 281, a communications module 282, a flash memory module 283, a port module 284, and a battery 285. The control module 24 has a main control circuit 241*a*, and the main control circuit 241*a* is electrically connected to the storage module 281, the communications module 282, the flash memory module 283, the port module 284, the battery 285, the key module 244, the light emitting elements 232, the Hall elements 231, the display screen 243, and the voice module 242. The battery 285 may be electrically connected between the port module 284 and the main control circuit 241*a*, and may be charged by a charging voltage from the port module 284 under control of the main control circuit 241*a*. The port module 284 may be a Type-C port module.

Figure 8:
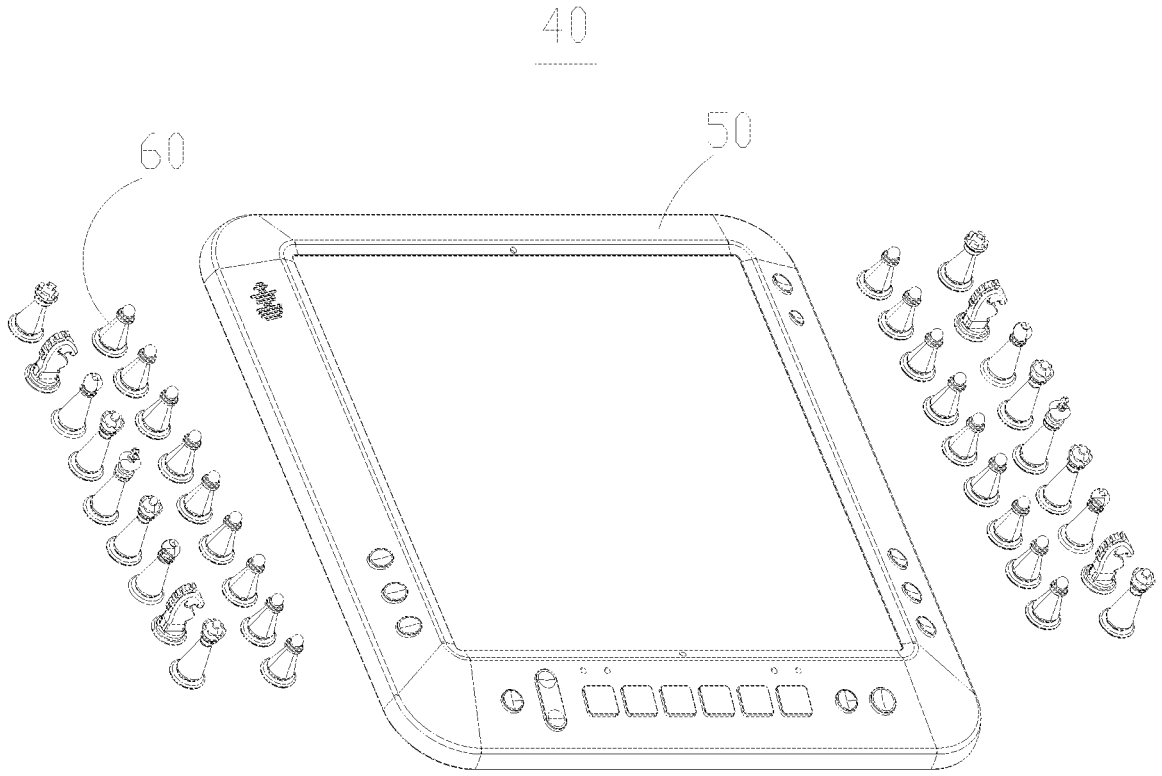
FIG. 8 is a schematic structural diagram of a chess according to a second embodiment of the present disclosure, the chess including a chessboard and chess pieces.
Figure 9:
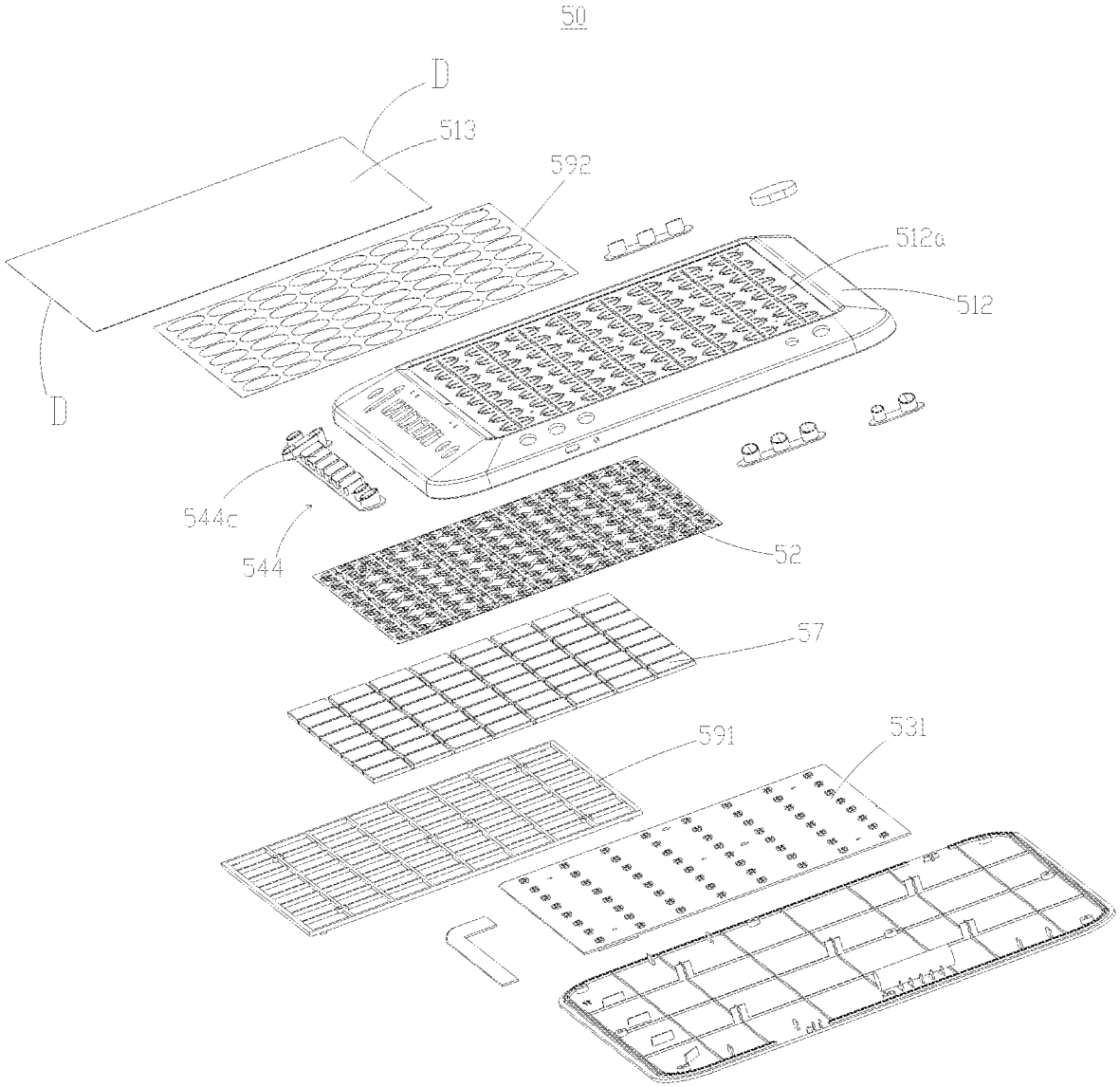
FIG. 9 is an exploded view of the chessboard according to the second embodiment of the present disclosure.

Referring to FIG. 8 and FIG. 9, the intelligent chess 40 in the second embodiment is basically the same as the intelligent chess 10 in the first embodiment. That is, descriptions of the intelligent chess 10 in first embodiment may be basically applicable to the intelligent chess 40 in second embodiment. The following mainly describes differences between the intelligent chess 40 in the second embodiment and the intelligent chess 10 in the first embodiment.

In the second embodiment, the first magnetic absorbing element 52 is arranged between the main area 512*a* of the front case 512 and the Hall elements 531, the intelligent chessboard 40 further includes a bracket 591, and the bracket 591 is located between the light guiding plate 57 and the Hall elements 531 and is configured to support the light guiding plate 57. The cover plate 513 is adhered to the main area 512*a* through the adhesive layer 592. The intelligent chess 50 in the second embodiment may not have a display screen.

Further, the key 544 may further include at least one pawn promotion key 544*c*, where the pawn promotion key 544*c* is a control key that is used to generate a pawn promotion control signal during operation to control a chess piece 60 that currently represents a Pawn and reaches a pawn promotion area D (such as an opponent's bottom line) to become a chess piece 60 that represents a Queen, a Knight, a Rook, or a Bishop. In this embodiment, the key 544 includes a plurality of pawn promotion keys 544*c*, and the plurality of pawn promotion key 544*c* are respectively representing promotion to a Queen, a Knight, a Rook, or a Bishop, and are configured to: generate a pawn promotion control signal to control a chess piece 60 representing a Pawn that currently arrives in a pawn promotion area D to become a chess piece 60 representing a Queen, a Knight, a Rook, or a Bishop respectively when being triggered.

The technical features in the foregoing embodiments may be combined in any manner. To make the description brief, all possible combinations of the technical features in the foregoing embodiments are not described. However, as long as there is no contradiction between the combinations of the technical features, it should be considered as the scope described in this specification. The foregoing embodiments represent only several embodiments of the present disclosure, and descriptions thereof are relatively specific and detailed, but may not be construed as a limitation on the scope of the present disclosure. It should be noted that an ordinary person skilled in the art may make some modifications and improvements without departing from the concept of the present application, which are within the protection scope of the present application.

What is claimed is:

1. A chessboard, comprising:

a housing, having a chessboard area, wherein the chessboard area comprises a plurality of chess squares;

at least one first magnetic attractable element, arranged in the housing and corresponding to the chessboard area, configured to be attracted by a second magnetic attractable element of at least one chess piece through a magnetic force; and a plurality of Hall elements, arranged in the housing and corresponding to the plurality of chess squares respectively, wherein each Hall element is configured to detect the second magnetic attractable element of the at least one chess piece on the chess squares, and output a detected signal; and a control module, electrically connected to the plurality of Hall elements and configured to receive the detected signal to get information on the at least one chess piece on the chess squares;

wherein the housing comprises a bottom case, a front case, and a cover plate, wherein the front case is connected to the bottom case to enclose an accommodating space, the Hall elements are arranged in the accommodating space, the front case has a main area, the chessboard further comprises a plurality of light emitting elements arranged in the accommodating space and corresponding to the plurality of chess squares respectively, wherein the cover plate is a light transmitting element, the main area is light-transmitting, and light emitted by the light emitting elements is emitted out of the chessboard through the main area, hollowed-out areas of the at least one first magnetic attractable element, and the cover plate; and the control module is arranged in the housing and is electrically connected to the light emitting elements and the Hall elements, and the control module is further configured to control on and off of the light emitting elements according to the detected signal;

wherein if there are multiple candidate chess squares that a current chess piece of the at least one chess piece on a current chess square of the plurality of chess squares can be moved on, the control module further controls the light emitting elements corresponding to the multiple candidate chess squares to emit the light in different colors and/or brightnesses, and the different colors and/or brightnesses are configured to indicate different recommended levels of moving the current chess piece.

2. The chessboard according to claim 1, the chessboard area is arranged on the cover plate, the cover plate is arranged on a side of the front case away from the bottom case and covers the main area; and the first magnetic attractable element is arranged on the front case and is configured to be attracted by the at least one chess piece through the magnetic force via the cover plate.

3. The chessboard according to claim 2, further comprising a chess accommodating drawer, one side of the bottom case defines a drawer opening, and the chess accommodating drawer is mounted in the drawer opening and slidably connected to the bottom case, so that the chess accommodating drawer may be switched between an accommodating state where the chess accommodating drawer is accommodated inside the bottom case and an extended state where at least a part of the chess accommodating drawer extends out of the bottom case through the drawer opening; and the Hall elements are arranged between the chess accommodating drawer and the front case.

4. The chessboard according to claim 2, wherein the first magnetic attractable element is arranged between the main area of the front case and the cover plate or between the main area of the front case and the Hall elements; and the first magnetic attractable element is of a metal material and comprises a plurality of magnetic attractable regions corresponding to the chess squares, and each hollowed-out area is provided on a corresponding one of the plurality of magnetic attractable regions.

5. The chessboard according to claim 4, further comprising a light guiding plate, the light guiding plate is arranged on a side of the light emitting elements adjacent to the main area, and the light emitted by the light emitting elements enters the main area through the light guiding plate.

6. The chessboard according to claim 5, wherein the chessboard further comprises a bracket, and the bracket is arranged between the light guiding plate and the Hall elements and is configured to support the light guiding plate; the chessboard further includes a circuit board, the light emitting elements and the Hall elements are arranged on the circuit board and are electrically connected to the circuit board, the circuit board is further electrically connected to the control module, and the light emitting elements and the Hall elements that corresponding to each of the chess squares are arranged adjacent to each other.

7. The chessboard according to claim 4, wherein each hollowed-out area comprises a plurality of first hollowed-out areas and multiple second hollowed-out areas surrounding each first hollowed-out area; and the main area comprises multiple third hollowed-out areas corresponding to the second hollowed-out areas and multiple supporting members each surrounded by several third hollowed-out areas, and the support members are corresponding to the first hollowed-out areas one by one and each of the support members has a same shape with a corresponding one of the first hollowed-out areas.

8. The chessboard according to claim 4, wherein the plurality of chess squares comprises a plurality of first chess squares having a first printed pattern and/or material and a plurality of second chess squares having a second printed pattern and/or material different from the first printed pattern and/or material.

9. The chessboard according to claim 4, wherein the information on the at least one chess piece comprises information about whether one of the at least one chess piece is placed on one of the chess squares, the control module determines, according to the detected signal, whether the current chess piece is placed on the current chess square and whether the current chess piece on the current chess square is leaving the current chess square, and the control module is further configured to: record identity information of the chess piece on each of the chess squares, and control, when the current chess piece on the current chess square is detected to be leaving the current chess square, the light emitting elements corresponding to one or more of the chess squares surrounding the current chess square to emit the light, so as to indicate the one or more chess squares that the current chess piece on the current chess square can move on; and the control module is further configured to: control the light emitting element corresponding to the current chess square to emit the light to display the identity information of the current chess piece on the current chess square when it is detected that the current chess piece on the current chess square is leaving the current chess square.

10. The chessboard according to claim 9, wherein the control module is further configured to control a current Hall element of the plurality of Hall elements corresponding to the current chess square to re-detect chess information or to output information that reminds a user to move the current chess piece to a previous position, when information on the current chess piece cannot be got according to the detected signal.

11. The chessboard according to claim 1, wherein the chessboard is configured with a companion mode, a competition mode, and a double-person mode, in the companion mode, the chessboard is configured with multiple optional difficulty levels, in the competition mode, the chessboard disables sound and/or the light, and in the double-person mode, the chessboard records game information and supports replaying a chess game.

12. The chessboard according to claim 1, further comprising a voice module, the voice module is electrically connected to the control module, and the control module is further configured to control the voice module to play a voice to report a current game situation, reminder information, chess abnormal information, and/or urging an opponent to play chess.

13. The chessboard according to claim 1, wherein the housing further comprises a display opening, the chessboard further comprises a display screen, the display screen is arranged in the housing and exposed through the display opening, and the display screen is configured to display current game information and a game result simultaneously; and the display screen is an electronic ink screen, and the display screen is arranged on a side of the chessboard area.

14. The chessboard according to claim 13, wherein the control module is further configured to: detect whether no chess piece is moved in a predetermined time period or whether a power key is triggered, and if no chess piece is moved in the predetermined time period or the power key is triggered, and a current game is recorded, and when the chessboard is powered on again or used again, the control module controls the display screen to continue displaying the current game.

15. The chessboard according to claim 1, wherein the chessboard further comprises a key module, the key module is used for operation by a user, the key module is electrically connected to the control module, and the control module is further configured to receive a control signal generated when the key module is triggered to control the chessboard;

and the key module comprises a start/pause key, the control module controls the chessboard to enable a new game or to or pause/continue a current game according to the control signal generated when the start/pause key is triggered, and the start/pause key is arranged on at least one side of the chessboard area.

16. The chessboard according to claim 15, wherein the key module further comprises at least one pawn promotion key, wherein the at least one pawn promotion key is a control key that is used to generate a pawn promotion control signal when being triggered to control a chess piece representing a Pawn that currently reaches a pawn promotion area to become a chess piece representing a Queen, a Knight, a Rook, or a Bishop.

17. The chessboard according to claim 1, wherein the chessboard has a chessboard time setting function, an endgame exercise function, at least one of playing chess according to a voice, the light, or a display screen prompt, a scoring function, and initiating draw, and if the endgame exercise function is enabled, the chessboard outputs the voice, the light, and/or the display screen prompt to prompt a user how to position chess pieces.

18. An intelligent chess set, comprising a chessboard as claimed in claim 1 and a plurality of chess pieces.

19. The intelligent chess set according to claim 18, wherein each chess piece defines a mounting slot at a bottom thereof, and the second magnetic attractable element is fastened in the mounting slot.

* * * * *